US010841716B2

(12) United States Patent
Perri et al.

(10) Patent No.: US 10,841,716 B2
(45) Date of Patent: Nov. 17, 2020

(54) HEARING DEVICE WITH TWO-HALF LOOP ANTENNA

(71) Applicant: Sonova AG, Stafa (CH)

(72) Inventors: Antonio Perri, Portalban (CH); Yves Oesch, Neuchatel (CH); Francois Callias, Fontaines (CH)

(73) Assignee: SONOVA AG, Stäfa (CH)

( * ) Notice: Subject to any disclaimer, the term of this patent is extended or adjusted under 35 U.S.C. 154(b) by 0 days.

(21) Appl. No.: 16/369,744

(22) Filed: Mar. 29, 2019

(65) Prior Publication Data

US 2020/0314566 A1 Oct. 1, 2020

(51) Int. Cl.

*H04R 25/00* (2006.01)
*H01Q 1/27* (2006.01)
*H01Q 7/00* (2006.01)

(52) U.S. Cl.

CPC ..... *H04R 25/554* (2013.01); *H01Q 1/273* (2013.01); *H01Q 7/005* (2013.01); *H04R 2225/51* (2013.01)

(58) Field of Classification Search

CPC ..... H04R 25/554; H04R 2225/51; H04R 2225/021; H04R 25/60; H01Q 7/005; H01Q 1/273; H01Q 7/00; H01Q 9/045; H01Q 9/26

See application file for complete search history.

(56) References Cited

U.S. PATENT DOCUMENTS 8,565,457 B2 10/2013 Polinske et al.
8,699,733 B2 4/2014 Polinske et al.
9,237,405 B2 1/2016 Pinto
9,294,850 B2 3/2016 Polinske et al.
9,571,944 B2 * 2/2017 Fischer ..... H04R 25/60
9,743,199 B2 8/2017 Polinske et al.
10,362,419 B2 * 7/2019 Kuhn ..... H01Q 1/273
2006/0109183 A1 * 5/2006 Rosenberg ..... H01Q 9/26 343/702

(Continued)

FOREIGN PATENT DOCUMENTS

WO 2014/090420 A1 6/2014

OTHER PUBLICATIONS

Dong Hyun Lee et al., "A compact and low-profile tunable loop antenna integrated with inductors", IEEE Antennas and Wireless Propagation Letters, vol. 7, 2008, pp. 621-624.

*Primary Examiner* — Oyesola C Ojo
(74) *Attorney, Agent, or Firm* — Pearne & Gordon LLP

(57) ABSTRACT

A hearing device includes a wireless communication unit, such as a radio frequency transceiver, and a two-half loop antenna. The antenna includes a conductor defining a first half loop and a second half loop configured to be fed in series with a radio signal from a radio frequency transceiver. The first half loop and the second half loop have mirror images forming respective half loops of the two-half loop antenna. Transverse segments of the first half loop and second half loop join the first half loop and the second half loop at a mid-point of the antenna near a feeding point. The physical antenna length of the antenna is less than ¾ of the wavelength of the radio frequency signal to be transmitted or received through the antenna. An electrical length of the antenna is approximately equal to the wavelength of the radio frequency signal to be transmitted or received.

27 Claims, 4 Drawing Sheets

(56) References Cited

U.S. PATENT DOCUMENTS

| | | | | |
|---|---|---|---|---|
| 2007/0080889 | A1* | 4/2007 | Zhang | H01Q 1/362 343/895 |
| 2007/0115200 | A1* | 5/2007 | Ishimiya | H01Q 5/357 343/803 |
| 2010/0201578 | A1* | 8/2010 | Parsche | H01Q 1/242 343/700 MS |
| 2010/0202639 | A1* | 8/2010 | Christensen | H01Q 1/44 381/315 |
| 2010/0302114 | A1* | 12/2010 | Kaikkonen | H01Q 7/00 343/722 |
| 2011/0068985 | A1* | 3/2011 | Hillersborg | H01Q 1/244 343/702 |
| 2011/0102286 | A1* | 5/2011 | Gualtieri | H01Q 7/00 343/817 |
| 2011/0210900 | A1* | 9/2011 | Vincent | H01Q 11/14 343/793 |
| 2015/0016645 | A1* | 1/2015 | Bauman | H04R 25/48 381/315 |
| 2015/0296312 | A1 | 10/2015 | Nikles et al. | |
| 2019/0349694 | A1* | 11/2019 | Farmakidis | H04R 25/554 |

* cited by examiner

HEARING DEVICE WITH TWO-HALF LOOP ANTENNA

FIELD OF INVENTION

The present disclosure relates to the field of hearing devices, such as hearing aids, having antennas adapted for wireless communication, such as for wireless communication with a hearing device accessory and/or one or more hearing devices.

BACKGROUND OF INVENTION

Hearing devices, such as hearing aids, earphones, and earbuds, for example, are tiny, delicate devices comprising many electronic and metallic components contained in a housing small enough to fit at least partially in the ear canal of a human or behind the outer ear. Several electronic and metallic components in combination with a small size of the hearing device housing impose several design constraints on radio frequency antennas to be used in hearing aids possessing wireless communication capabilities. Further, the antenna in the hearing device has to be designed to achieve a satisfactory antenna gain despite the size limitation and other design constraints.

An antenna converts electric power into radio waves and vice versa. To be resonant, it is desirable for an antenna to have a physical length and/or electrical length related to the wavelength of a radio wave to be transmitted over the antenna (or a multiple of that length). However, in compact devices such as hearing aids, length of an antenna conductor is limited by the size and shape of the hearing aid device. Further, antenna gain requirements of the hearing aid device also need to be accounted when designing an antenna for the hearing aid to meet the specifications.

SUMMARY

The claims are directed to a hearing device component.

The hearing device component includes a wireless communication unit and an antenna including a two-half loop antenna. The two-half loop antenna comprises: a conductor and interconnected tuning elements defining a first half loop and a second half loop configured to be fed in series with a wireless signal from the wireless communication unit, wherein the first half loop and the second half loop comprise respective half loops of the two-half loop antenna; the first half loop comprising a first end section of the first half loop, wherein the first end section of the first half loop is coupled to the wireless communication unit; the second half loop comprising a second end section of the second half loop, wherein the second end section of the second half loop is coupled to the wireless communication unit; respective transverse segments of the first half loop and second half loop join the first half loop and the second half loop at a mid-point of the two-half loop antenna; wherein a physical antenna length of the two-half loop antenna is less than ¾ of the wavelength of the wireless signal to be transmitted or received through the two-half loop antenna and wherein an electrical length of the two-half loop antenna is approximately equal to the wavelength of the wireless signal to be transmitted or received.

Feeding lines connect the wireless communication unit to a feeding point at the first end section of the first half loop and the second end section of the second half loop.

The distance between the feeding point of the two-half loop antenna and the mid-point of the two-half loop antenna is in a range of 0 to ¼ of the distance between the feeding point and a farthest point defined by a point at which an axial line through the feeding point and the mid-point intersects a plane perpendicular to the axial line and intersecting a point on the two-half loop antenna farthest from the feeding point.

The first and second half loops of the two-half loop antenna are configured to have a highest amplitude of the current flow in the transverse segments.

The two-half loop antenna has a first inversion point and a second inversion point, wherein the first inversion point is at the farthest distance or diagonally across from the first end section of the first half loop, and the second inversion point is at the farthest distance or diagonally across from the second end section of the second half loop.

A first distal point on the first half loop is located between the first end section of the first half loop and the first inversion point and a second distal point on the second half loop is located between the second end section of the second half loop and the second inversion point.

The first distal point and the second distal point are located at a separation distance that prevents the magnetic flux generated due to the currents flowing in the first half loop, and the magnetic flux generated due to the current flowing in the second half loop, from canceling the effect of each other.

The first inversion point and the second inversion point are located at a separation distance that prevents the magnetic flux generated due to the currents flowing in the first half loop and the magnetic flux generated due to the current flowing in the second half loop from canceling the effect of each other.

The wireless communication unit is a radio frequency transceiver the first and second inversion points correspond to zero crossing points of current in a one full-wavelength of a radio-frequency signal that exists over the two-half loop antenna when the radio-frequency signal is transmitted or received over the two-half loop antenna.

One of the one or more tuning elements are connected at a feeding point at the first end section of the first half loop and the second end section of the second half loop and in parallel between the first half loop and the second half loop.

A dielectric structure inside the hearing device component is configured to load the two-half loop antenna, wherein the electrical length of the two-half loop antenna being approximately equal to the wavelength of the wireless signal to be transmitted or received is caused at least partly by the load of the dielectric structure.

The electrical length of the two-half loop antenna is approximately equal to the wavelength of the wireless signal to be transmitted or received configured to be caused at least partly by the load of the dielectric structure in combination with dielectric loading by a user's head on which the hearing device component is configured to be worn.

The one or more tuning elements set the antenna impedance to match the electrical length of the two-half loop antenna to the wavelength of the wireless signal to be transmitted or received.

A dielectric structure inside the hearing device component and cooperating with the one or more tuning elements sets the antenna impedance to match the electrical length of the two-half loop antenna to the wavelength of the wireless signal to be transmitted or received.

One of the one or more tuning elements is connected at the mid-point of the two-half loop antenna.

The one or more tuning elements are one or more inductors and/or one or more capacitors.

The tuning elements are configured to provide an approximately equal current distribution between the first half loop and the second half loop.

The approximately equal current distribution of the antenna half loops is achieved using capacitors and/or inductors as the tuning elements in the first half loop and the second half loop.

The physical antenna length of the two-half loop antenna is less than one-half of the wavelength of the wireless signal to be transmitted or received through the two-half loop antenna.

The physical antenna length of the two-half loop antenna is less than ¼ of the wavelength of the wireless signal to be transmitted or received through the two-half loop antenna.

The physical antenna length of the two-half loop antenna is in the range of 3 centimeters to 9 centimeters.

The hearing device component also includes an antenna substrate wherein the two-half loop antenna includes conductors on an antenna substrate, and optionally one or more of each of the following: a microphone, a battery, and a housing, wherein the housing encloses one or more of the antenna substrate, the microphone, the battery, and the wireless communication unit.

The first half loop and the second half loop comprise loops substantially rectangular in shape, and wherein the diameter of the first rectangular loop is approximately equal to one-half of the physical length of the two-half loop antenna and the diameter of the second rectangular loop is approximately equal to one-half of the physical length of the two-half loop antenna.

The first half loop and the second half loop are laterally placed opposite to each other such that each side of the first rectangular loop and each corresponding side of the second rectangular loop are laterally opposite and separated by a predetermined separation distance.

A hearing device component comprises a wireless communication unit; and an antenna including a two-half loop antenna. The two-half loop antenna comprises: a conductor defining a first half loop and a second half loop configured to be fed in series with a wireless signal from the wireless communication unit, wherein the first half loop and the second half loop comprise respective half loops of the two-half loop antenna; the first half loop comprising a first end section of the first half loop, wherein the first end section of the first half loop is coupled to the wireless communication unit; the second half loop comprising a second end section of the second half loop, wherein the second end section of the second half loop is coupled to the wireless communication unit; respective transverse segments of the first half loop and second half loop join the first half loop and the second half loop at a mid-point of the two-half loop antenna. The component also comprises feeding lines connecting the wireless communication unit to a feeding point at the first end section of the first half loop and the second end section of the second half loop, wherein the distance between the feeding point of the two-half loop antenna and the mid-point of the two-half loop antenna is in a range of 0 to ¼ of the distance between the feeding point and a farthest point defined by a point at which an axial line through the feeding point and the mid-point intersects a plane perpendicular to the axial line and intersecting a point on the two-half loop antenna farthest from the feeding point.

A hearing device component comprises: a microphone for reception of sound and conversion of the received sound into a corresponding first audio signal; a signal processor for processing the first audio signal into a second audio signal; a wireless communication unit configured for wireless data communication; and an antenna for emission of an electromagnetic field, the antenna being coupled with the wireless communication unit, the antenna having a total length less than three quarters of a wavelength of the emitted electromagnetic field; wherein a part of the antenna extends from a first side of the component to a second side of the component; and wherein the antenna has a mid-point located at a part of the antenna extending from the first side to the second side.

The hearing device component includes feeding lines from the wireless communication unit and a feeding point at end sections of the antenna, wherein the distance between the feeding point and the mid-point is in a range of 0 to ¼ of the distance between the feeding point and a farthest point defined by a point at which an axial line through the feeding point and the mid-point intersects a plane perpendicular to the axial line and intersecting a point on antenna farthest from the feeding point.

BRIEF DESCRIPTION OF THE DRAWINGS

The foregoing and other aspects of the present disclosure will become apparent to those skilled in the art to which the present disclosure relates upon reading the following description with reference to the accompanying drawings, in which.

Figure 1:
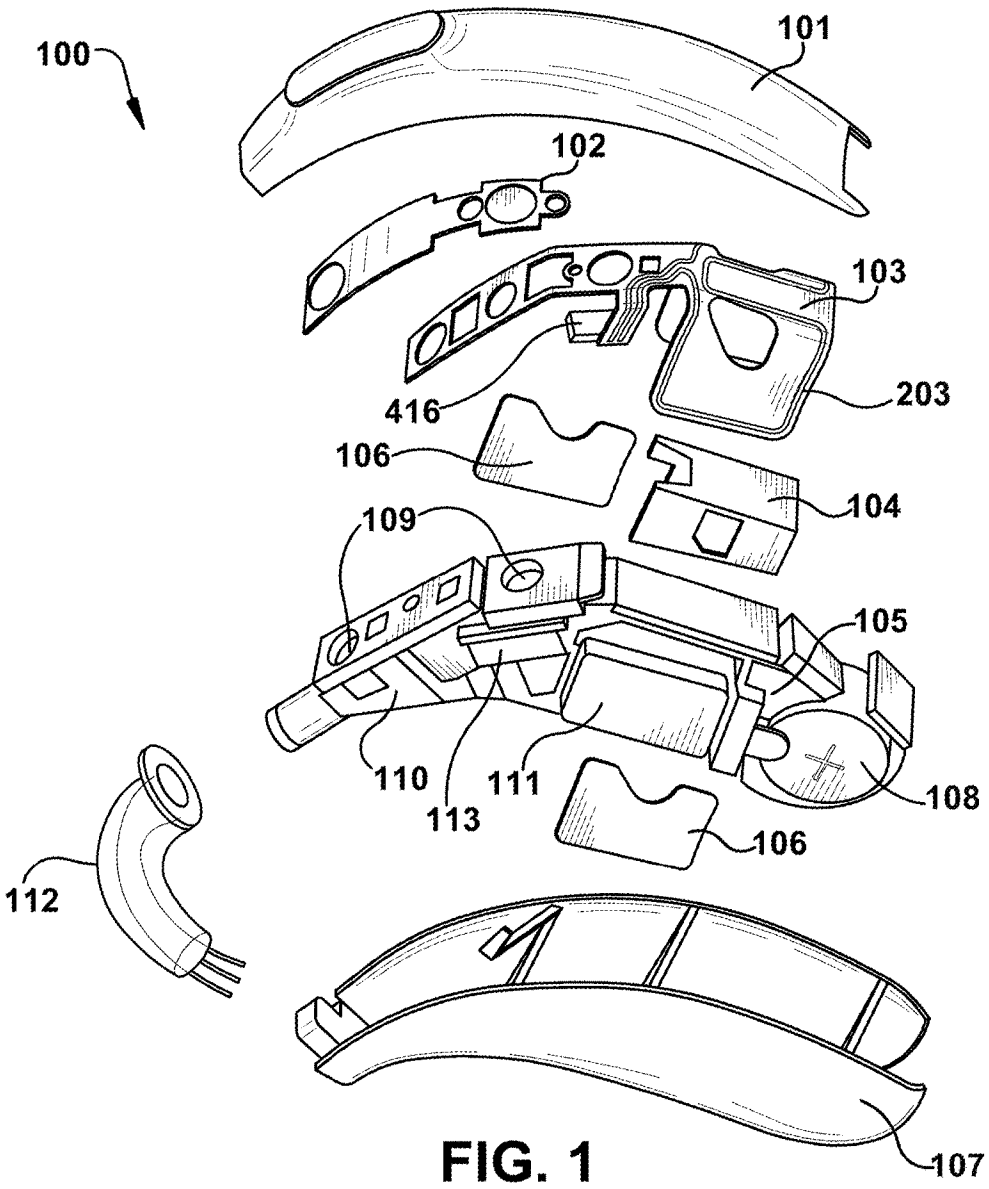
FIG. 1 is an exploded view illustrating several parts of a hearing device component.

Throughout the drawings and the detailed description, unless otherwise described, the same drawing reference numerals will be understood to refer to the same elements, features, and structures. The relative size and depiction of these elements may be exaggerated for clarity, illustration, and convenience.

DETAILED DESCRIPTION

Example embodiments that incorporate one or more aspects of the apparatus and methodology are described and illustrated in the drawings. These illustrated examples are not intended to be a limitation on the present disclosure. For example, one or more aspects of the disclosed embodiments can be utilized in other embodiments and even other types of devices. Moreover, certain terminology is used herein for convenience only and is not to be taken as a limitation. "Approximately" and "substantially", as used herein, means within a range that does not alter performance to an undesirable degree and may facilitate manufacturing within constraints of the parts of the hearing device.

FIG. 1 is exploded view illustrating several parts of a hearing device component. The illustrated hearing device is a behind-the-ear (BTE) component 100 of a hearing aid. Other hearing device components may include, for example, an in-the-ear (ITE) component of a hearing aid, an earbud, or an earphone. The hearing device component can be part of an audio system that wirelessly receives audio or other signals from another device, component or system, such as a hearing aid controller, a mobile phone, a hearing loop system, an audio link device, or streaming device. Audio is transmitted to the user, for example, by a speaker in the hearing device component, a speaker connected to the hearing device component, or a cochlear implant connected to the hearing device component. The illustrated hearing aid component 100 can include a top housing 101, a microphone cover 102, an antenna substrate, such as a printed circuit board (PCB) assembly 103, an antenna holder 104, a hearing aid internal structure 105, one or more adhesive tapes 106, a bottom housing 107, battery 108, one or more microphones 109, a signal processor 113, and a sound tube 110 for outputting sound from a speaker (also known as a "receiver") 111 to a tubing 112. The top housing 101 forms the top cover of the hearing aid. The top housing 101 may be made of a single material or composition of plural materials. In one example, the top housing 101 is made of plastic. In one example, the top housing forms a behind-the-ear hearing aid hook that covers the outside of a user's ear. The top housing 101 can connect the hearing aid component 100 to the tubing 112, which can be connected to an ear mold.

The hearing aid component 100 can include the microphone cover 102 that forms a protective covering for the microphone 109 of the hearing aid component 100. In one example, the microphone cover 102 provides noise isolation to the microphone of the hearing aid component 100 to reduce or prevent ambient noise at the input of the microphone of the hearing aid component 100. The antenna PCB assembly 103 includes the two-half loop antenna 203 of the present invention as described further below with reference to FIGS. 2, 3A, and 3B. In one implementation, the antenna PCB assembly 103 includes a flexible PCB structure. In one example, the antenna holder 104 is used as a frame structure for the PCB structure. In one example, the adhesive tape 106 is used to fix the antenna PCB assembly 103 to an internal structure of hearing aid component 100.

The hearing aid component 100 can include the internal structure 105. The internal structure 105 can hold one or more components and sub-components of the hearing aid component 100 necessary to support the functioning of the hearing aid component 100. For example, the internal structure 105 can hold the microphone 109, which may by a system including more than one microphone. The microphone may be directional i.e., pick up most sounds in front a person wearing the microphone, or omnidirectional i.e., pick up sounds from all directions. The internal structure 105 may further include a signal processor 113, which receives electric signals received from the microphone and converts them into digital signals that can be processed further. The signal processor may comprise more than one processor. The signal processor 113 may be adapted to differentiate sounds, such as speech and background noise, and process the sounds differently for a seamless hearing experience. The signal processor in the internal structure 105 also supports cancellation of feedback or noise from wind, ambient disturbances, etc. The signal processor in the internal structure 105 also supports conversion of digital signals to analog signals, which are transmitted to the speaker 111 or a transducer of the cochlear implant. In some configurations, the speaker is in a component, such as a component to be worn in the ear, that is separate from the hearing aid component 100 and electrically connected to the hearing aid component. The internal structure 105 may also hold a wireless communication unit, such as a radio frequency (RF) transceiver 416, that receives and optionally transmits wireless signals. The RF transceiver 416 may receive wireless audio signals and/or control signals from a remote device and convey them to the signal processor 113 or other part of the hearing aid component 100. The RF transceiver 416 may also transmit wireless audio signals and/or control signals from the signal processor 113 or other part of the hearing aid component 100 to a remote device. The RF transceiver may be a transmitter only or a receiver only. The remote device may include a hearing aid controller, a mobile phone, a hearing loop system, an audio link device, a streaming device, or another hearing aid component, for example. Further, the internal structure 105 may hold other parts such as the battery 108, etc. For simplification, components on the internal structure 105 that support the functionality of the hearing aid component 100 are not described in detail. The hearing aid component 100 also includes the bottom housing 107 that may form the outer cover and provide any needed support to the hearing aid component 100. The top cover 101 and bottom housing 107 cooperate to form a housing enclosing the parts of the hearing aid component. Other housing configurations with one, two, or more housing parts can be used.

Figure 2:
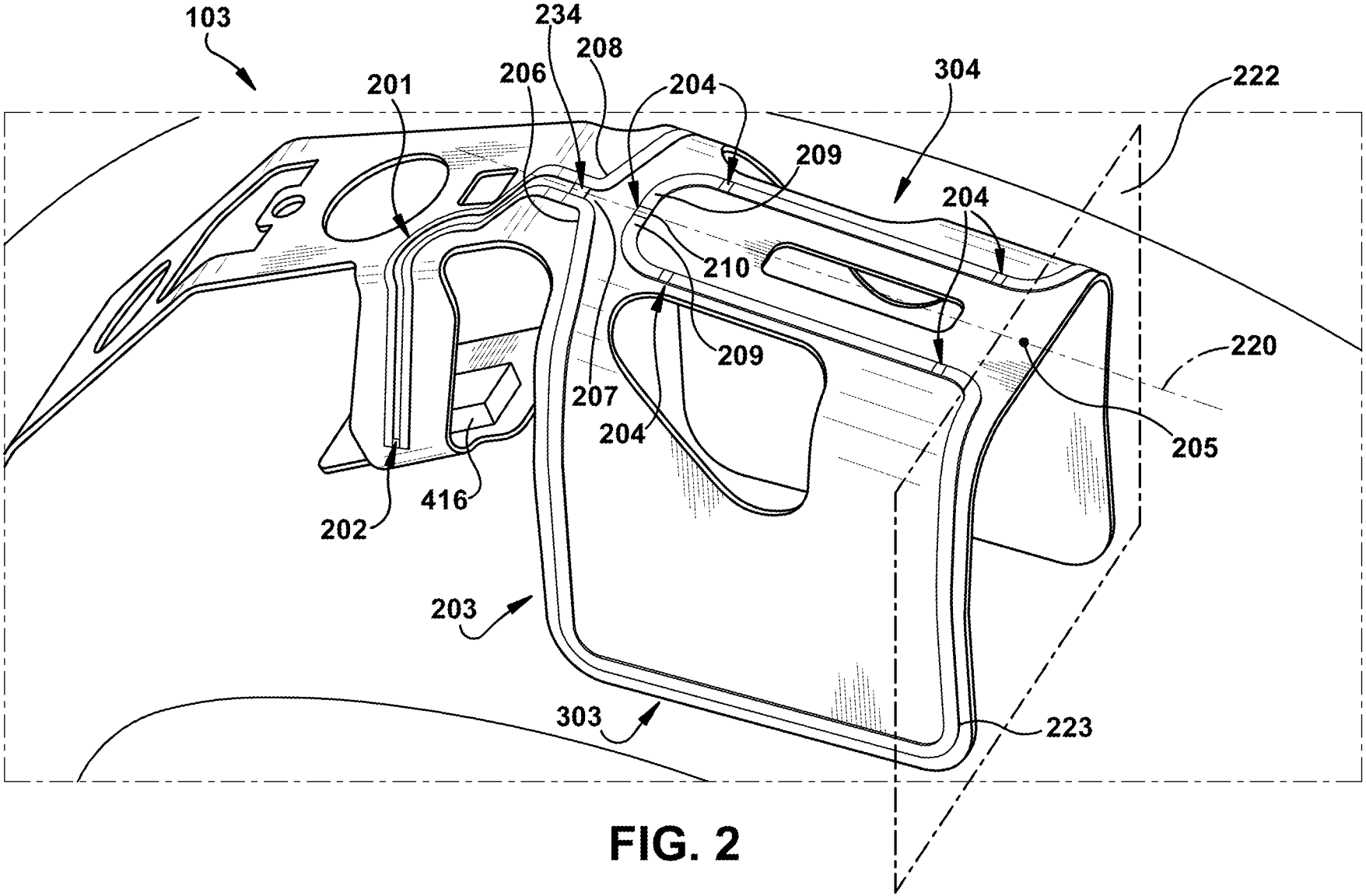
FIG. 2 is a schematic diagram illustrating an antenna printed circuit board (PCB) with a two-half loop antenna layout.

FIG. 2 is a schematic diagram illustrating the antenna substrate shown as the antenna printed circuit board (PCB) 103. An antenna assembly can include the substrate and a conductor configured as an antenna. FIG. 2 illustrates the layout of the two-half loop antenna 203 as the conductor formed as a conductive trace on the antenna PCB 103. For example, the conductor may be a 0.5 mm wide copper track formed on a 120 μm polyimide substrate. In another implementation, the two-half loop antenna may be implemented through MID (Molded Interconnect Devices) or LDS (Laser Direct Structuring) on parts of an internal frame or an external housing of the hearing aid or other known techniques of applying a conductor on a substrate or otherwise forming an antenna. The two-half loop antenna 203 includes a feeding point 207, a first end section of the first half loop 206, a second end section of the second half loop 208, a mid-point 210, and tuning elements 204. FIG. 2 also shows a coupling point 202 and feeding lines 201 that can be used to connect the antenna 203 to the RF transceiver 416 via the feeding point 207. The RF transceiver 416 can be installed at other locations. For example, the RF transceiver can be located at the feeding point 207 such that the feeding lines are very short or feeding lines are simply the output terminals of the RF transceiver and the end sections 206, 208 of the first and second half loops are connected directly to the RF transceiver. The RF transceiver 416 can communicate a radio frequency signal (RF signal) to be received or transmitted over the two-half loop antenna 203. The feeding lines 202 may be metallic wires, or channels of metallic conductors that carry the RF signal to or from the feeding point 207 of the two-half loop antenna 203 without loss or with minimal loss. The feeding lines 201 can include two parallel conductors that are laid out on the antenna PCB assembly 103 at a small separation distance. For example, the separation distance between the two parallel conducting channels of the feeding lines 201 is small enough that the currents (i.e., the current in the conductors corresponding to the signal carried by the feeding lines 201) through the two parallel conductors effectively cancel any resulting magnetic flux due to current transmission through the two parallel conducting channels and there is little or no radiation of power from the feeding lines 201. The feeding lines 201 can communicate the RF signal to be transmitted or received through the two-half loop antenna 203 via the feeding point 207. In one implementation, a first conductor of the feeding lines 201 connects the RF transceiver to the first end section of the first half loop 206, and a second conductor of the feeding lines 201 connects the RF transceiver to the second end section of the second half loop 208. The connections of first end section of the first half loop 206 and the second end section of the second half loop 208 to the feeding lines 201 together comprise the feeding point 207.

The feeding point 207 of the two-half loop antenna 203 marks the beginning of the two-half loop antenna 203 for the purpose of measuring a physical length of the two-half loop antenna 203. The feeding point 207 is also the beginning point of the two-half loop antenna 203 where the two-half loop antenna 203 begins to transmit (that is, radiate) or receive the RF signal that is communicated from or to the RF transceiver 416. At the feeding point 207, the first end section of the first half loop 206 and the second end section of the second half loop 208 are in proximity to each other and conductors forming antenna segments of the first half loop and the second half loop of the two-half loop antenna 203 leading from the feeding lines may be parallel similar to the feeding lines. The feeding point 207 defines a point at which the conductors forming a first half loop 303 and a second half loop 304 become sufficiently separate from each other so that they can radiate or receive the RF signal. At opposite ends of the first and second half loops 303, 304 from the end sections 206, 208, the first half loop and the second half loop of the two-half loop antenna 203 can have transverse segments 209 that join each other at a mid-point 210 of the two-half loop antenna.

Figure 3B:
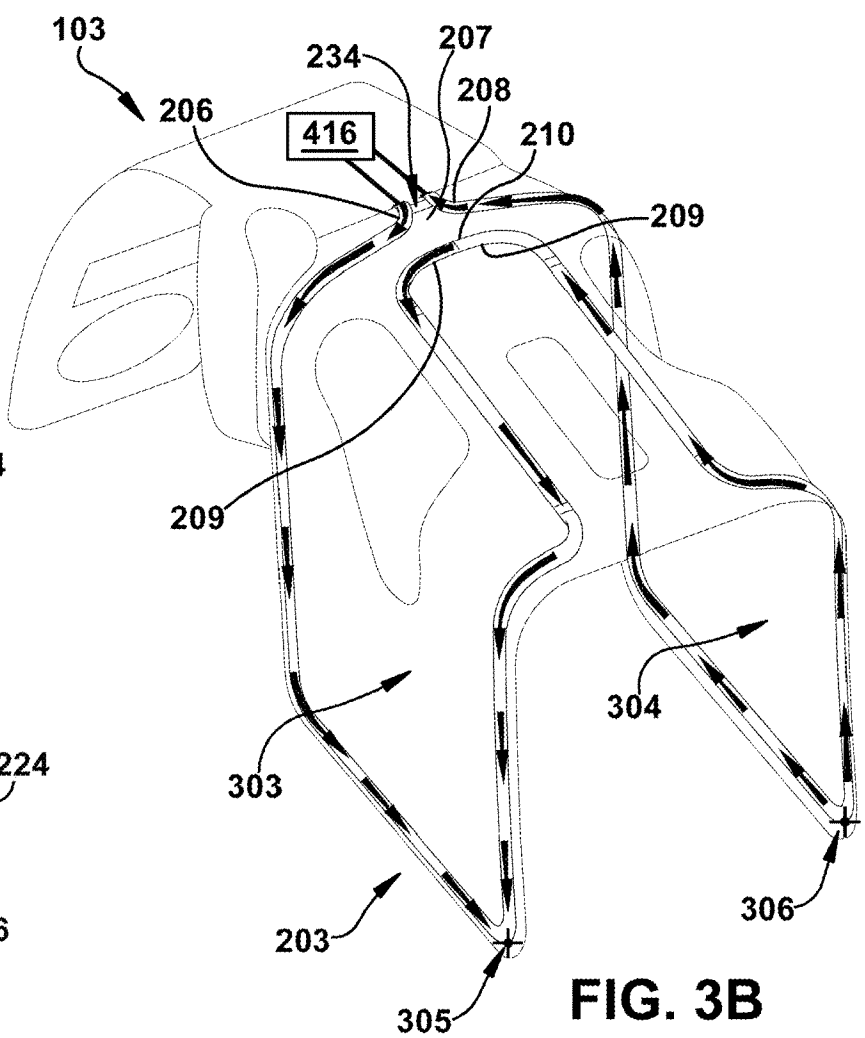
FIG. 3B illustrates a current flow across the two-half loop antenna when a radio frequency signal is transmitted over the two-half loop antenna.
Figure 3A:
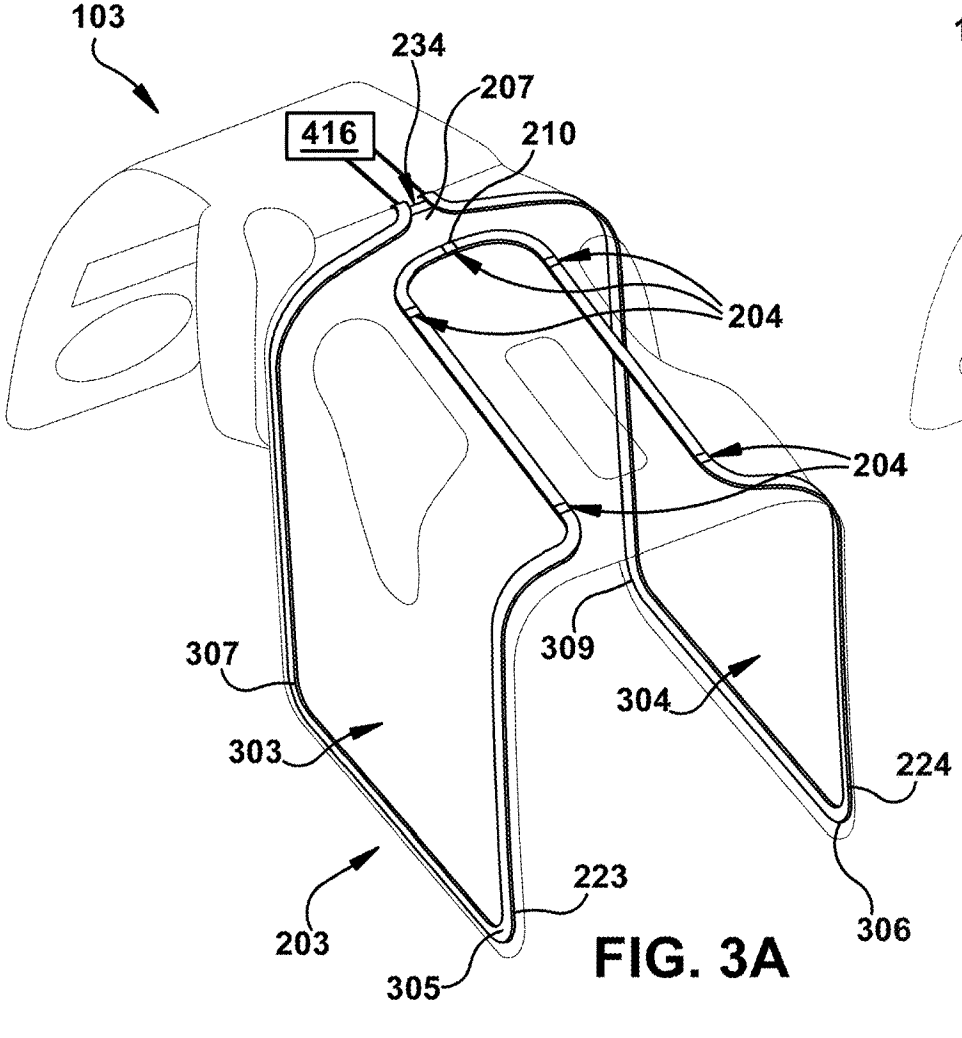
FIG. 3A illustrates the geometry of the two-half loop antenna design with two rectangular loops.

FIG. 3A illustrates the geometry of the two-half loop antenna design with two rectangular loops. FIG. 3A includes the two-half loop antenna 203 with the feeding point 207, the mid-point 210, the first half loop 303, the second half loop 304, a first distal point 307 on the first half loop 303, a first inversion point 305 on the first half loop 303, a second distal point 309 on the second half loop 304, a second inversion point 306 on the second half loop 304, and tuning elements 204. The configuration of the second half loop 304 is a mirror image of the configuration of the first half loop 303. In the illustrated example, the first half loop 303 and the second half loop 304 can form individual half loops defining a substantially rectangular area each extending symmetrically and approximately parallel to each other along side faces of the hearing aid device 100 in a saddle-like manner. Although referred to as "half loops" the first half loop 303 and second half loop 304 can be asymmetrical with respect to each other in length and/or configuration. For simplification, and to focus on the geometry of the two-half loop antenna 203, an RF transceiver, feeding lines, and a coupling point are not shown in FIG. 3A. The length of the first half loop 303 of the two-half loop antenna 203 is the length of the conductor of the two-half loop antenna 203 from the first end section of the first half loop 206 to the mid-point 210, and the length of the second half loop 304 of the two-half loop antenna 203 is the length of the conductor of the two-half loop antenna 203 from the second end section of the second half loop 208 to the mid-point 210. The sum of the lengths of the first half loop and the second half loop comprises the physical antenna length of the two-half loop antenna. The mid-point is approximately halfway along the physical length of the conductor of the two-half loop antenna 203.

Referring to FIG. 2, the hearing aid component includes a farthest point 205 illustrated, as an example, between the first half loop 303 and second half loop 304 of the two-half loop antenna 203. An axial line 220 passes through the feeding point 207 and the mid-point 210. A transverse plane 222 is perpendicular to the axial line 220 and intersects a point on the two-half loop antenna 203 that is farthest from the feeding point 207. The intersection of the axial line 220 and the transverse plane 222 defines the farthest point 205. As shown in FIG. 3A, there are two points 223, 224 on the two-half loop antenna 203 that are equidistant and farthest from the feeding point 207. In this example, the transverse plane intersects both of these points 223, 224. In one implementation, the configuration of the two-half loop antenna 203 is such that the distance between the feeding point 207 and the mid-point 210 is in the range of 0 to ¼ of the distance between the feeding point 207 and the farthest point 205.

The two-half loop antenna 203 can utilize lumped-impedance matching and/or loading to obtain a desired effective electrical length of the two-half loop antenna 203. For example, an antenna having a physical length shorter than a quarter of the wavelength of the radio frequency signal to be transmitted over the antenna presents capacitive reactance, and some of the applied power is reflected back into the transmission line which travels back toward the transmitter. Therefore, to increase the effective electrical length of the antenna and to make the antenna resonant at the transmission frequency, a loading coil can be inserted in series with the antenna. The inductive reactance of the loading coil is approximately equal and opposite to, and cancels, the capacitive reactance of the antenna, so the loaded antenna presents a pure resistance to the transmission line and thereby prevents energy from being reflected. In the two-half loop antenna 203, impedance loading can be achieved by use of one or more tuning elements 204, 234 connected to the two-half loop antenna 203. That is, the tuning elements 204, 234 are interconnected with the conductor of the two-half loop antenna 203 In some embodiments, the tuning elements 204 may be one or more capacitors, as described further in description of FIG. 4A. In some embodiments, the tuning elements 204 may be inductors, as described further in description of FIG. 4B.

The tuning elements 204 can be connected in series with the two-half loop antenna 203. In one implementation, the tuning elements 204 are approximately equally distributed across the first half loop 303 and the second half loop 304 of the two-half loop antenna 203. In another implementation, the first half loop and the second half loop may be unequally loaded (for example by an adding an unequal number of tuning elements in the first half loop and the second half loop, or by using the same number of tuning elements in the first and second half loops but with unequal impedance values). Further, in yet another implementation the number of the tuning elements 204 in the first half loop and the second half loop may be different, however, the impedance value added to the first half loop and the second half loop may be approximately equal (by using tuning elements of different values in the first and second half loops). The number of tuning elements 204 and their respective values can be chosen based on the wavelength ($\lambda$) of the radio frequency signal to be transmitted or received through the two-half loop antenna 203. Combinations of capacitors and/or inductors may be used as tuning elements with respective values selected to achieve a desired impedance. In one implementation, the tuning elements may be selected to achieve equal current distribution between the two half loops.

The total physical length of the two-half loop antenna 203 (i.e., the sum of the length of the first half loop and the second half loop) is less than (¾)λ, i.e., less than three-fourths of the wavelength of the radio signal to be transmitted or received through the two-half loop antenna. The total electrical length of the two-half loop antenna 203 is one wavelength (λ). Therefore, from the perspective of the functioning of the two-half loop antenna 203, the two-half loop antenna 203 antenna is equivalent to two half-wave loops fed in series with the radio frequency signal to be transmitted or received.

In some implementations, the tuning elements 204 are coils which are used to increase the electrical length of the two-half loop antenna 203 up to one wavelength (λ). In other implementations, the two-half loop antenna 203 may be loaded by a nearby dielectric structure, such as the PCB 103 or antenna holder 104, inside the hearing aid component 100, and the dielectric structure in combination with a loading due to a user's head, can contribute to increase in the electrical length of the two-half loop antenna 203 up to one wavelength (λ). For this reason, in certain situations the two-half loop antenna 203 may become electrically longer than one wavelength (λ). Therefore, in some implementations, due to such constraints, one or more capacitors may be used as the tuning elements 204, as described further in FIG. 4A.

In one implementation, the physical antenna length of the two-half loop antenna 203 is less than one-half of the wavelength (λ) of the radio frequency signal to be transmitted or received through the two-half loop antenna 203. The electrical length of the two-half loop antenna 203 in such implementation can be achieved to be approximately equal to the wavelength (λ) of the radio frequency signal to be transmitted through use of one or more tuning elements 204.

In another implementation, the physical antenna length of the two-half loop antenna 203 is less than one-quarter of the wavelength (λ) of the radio frequency signal to be transmitted or received through the two-half loop antenna 203. The electrical length of the two-half loop antenna 203 in such implementation can be achieved to be approximately equal to the wavelength (λ) of the radio frequency signal to be transmitted through use of one or more tuning elements 204.

In yet another implementation, the physical antenna length of the two-half loop antenna 203 is less than three-quarters of the wavelength (λ) of the radio frequency signal to be transmitted or received through the two-half loop antenna 203. For example, when the frequency of the radio signal to be transmitted or received through the two-half loop antenna 203 is 2.4 GHz, the physical antenna length of the two-half loop antenna 203 can be less than 9 cm, and preferably in the range of 3 cm to 9 cm. The electrical length of the two-half loop antenna 203 in such implementation is achieved to be approximately equal to the wavelength (λ) of the radio frequency signal to be transmitted or received through use of one or more tuning elements 204.

In one implementation, the choice of the tuning elements 204 with one or more desired values can be used to steer the radiation pattern of the two-half loop antenna 203. For example, the choice of the value of the tuning elements 204 could be selected such that the first half loop is slightly more compensated than the second half loop of the two-half loop antenna 203 thereby allowing a slight steering of the radiation pattern. The steering of the radiation pattern is due to the slight mismatch of the input impedance of the first half loop and the second half loop of the two-half loop antenna 203. Such steering of the radiation pattern of the two-half loop antenna 203 can be used to optimize the two-half loop antenna 203 for a certain architecture of the hearing aid component 100 (for example, design of the hearing aid component 100 with the two-half loop antenna 203 having a radiation pattern which is not symmetrical on the transverse plane).

In one implementation, the mid-point 210 and the feeding point 207 of the two-half loop antenna 203 are located on conductor segments which are orthogonal to a skin surface on which the hearing aid component 100 that includes the two-half loop antenna 203 is to be worn. The orthogonality of the conductor segments to the skin surface over which the two-half antenna 203 is to be worn allows communication between hearing aids placed at left and right sides of the head of a user. This allows the two-half loop antenna 203 to achieve a higher antenna gain and which could help in implementing solutions to reduce power consumption of the hearing aid component 100 due to a link with another device. In one implementation, the two-half loop antenna 203 has a radiation pattern such that the power radiated by the two-half loop antenna 203 is maximal on a horizontal plane radiating away from a user's head when worn by a user in an upright position.

In some implementations, the feeding point 207 of the two-half loop antenna 203 may not be exactly in the lateral center of the antenna PCB assembly 103, but the feeding point 207 may be slightly shifted to the left or to the right of the antenna PCB assembly 103 to accommodate one or more design considerations of the hearing aid component 100. The term "slightly shifted" signifies that the difference in location of the feeding point 207 is not significant enough to impact the operation of the two-half loop antenna 203. The results obtained through simulations with the feeding point 207 "slightly shifted" resemble antenna radiation patterns with a design in which the feeding point 207 is in exact lateral center of the antenna PCB assembly 210.

The two-half loop antenna 203 as described above provides several distinct advantages over traditional antenna design including requirement of reduced number of the tuning elements 204 in the two-half loop antenna 203 for tuning with respect to magnetic loop antennas. Further, an additional tuning element can be placed in parallel with the antenna 203 or one of the loops 303, 304 to compensate for possible impedance mismatch in the two-half loop antenna 203 design. As illustrated, for example, the tuning element 234 is connected in parallel between the two half loops 303, 304 and may comprise one or more capacitors. Additional series tuning elements can also be added, for example, in the transverse segments 209 of the first half loop and second half loop. The tuning elements 204, 234 are further described below with reference to FIGS. 4A and 4B.

Referring to FIGS. 3A and 3B, the two-half loop antenna 203 comprises two loops fed in series with an RF signal as described above. The first half loop 303 of the two-half loop antenna 203 is a rectangular loop beginning at the feeding point 207 of the two-half loop antenna 203 and ending at the mid-point 210. The second half loop 304 of the two-half loop antenna 203 is a rectangular loop beginning at the feeding point 207 of the two-half loop antenna 203 and ending at the mid-point 210. The first half loop 303 and the second half loop 304 are in a lateral arrangement facing each other. Further, the first half loop 303 includes the first distal point 307 which lies between the coupling point 207 and the first inversion point 305. The second half loop 304 includes the second distal point 309 which lies between the feeding point 207 and the second inversion point 306.

The first distal point 307 and the second distal point 309 are separated by a separation distance such that magnetic flux generated due to current flowing through the first half loop 303 and magnetic flux generated due to current flowing through the second half loop 304 do not cancel the effect of each other. Current flowing through the first half loop 303 and the second half loop 304 refers to the current resulting from a radio frequency signal in the two-half loop antenna 203. In a similar manner, the first inversion point 305 on the first half loop 303 and the second inversion point 306 on the second half loop 304 are separated by a separation distance such that the magnetic flux generated due to the current flowing through the first half loop 303 and the magnetic flux generated due to the current flowing through the second half loop 304 do not cancel the effect of each other.

In some embodiments, the first half loop 303 and the second half loop 304 may not necessarily be rectangular in shape, and may comprise another geometrical shape forming a loop, such as a square shape, circular shape, or oval shape. These shapes can include rounded corners and/or straight sides (as shown in the examples of FIGS. 3A and 3B) such that they are not strictly rectangular, square, circular, or oval, but form a loop substantially conforming to such a shape. A diameter of the loop is a transverse dimension that does not necessarily imply that the shape is circular. The diameter of the first half loop 303 and the diameter of the second half loop 304 are approximately equal to one-half of the physical length of the two-half loop antenna 203. The first half loop 303 and the second half loop 304 can be placed in a lateral arrangement on opposite sides of the hearing aid component 100. The first half loop 303 and the second half loop 304 can be positioned opposite to each other such that each side of the first half loop 303 and each corresponding side of the second half loop 304 are laterally opposite to each other and are separated by a predetermined separation distance. In one implementation, the predetermined separation distance is at least the distance such that the magnetic flux generated due to the current flowing through the first half loop 303 and the magnetic flux generated due to the current flowing through the second half loop 304, do not cancel the effect of each other.

FIG. 3B illustrates a current flow across the two-half loop antenna when a radio frequency signal is transmitted over the two-half loop antenna. FIG. 3B includes the two-half loop antenna 203 with the feeding point 207, the mid-point 210, the first half loop 303, the first end section 206 of the first half loop, the second half loop 304, the first end section 208 of the second half loop, the first inversion point 305 on the first half loop 303, the second inversion point 306 on the second half loop 304.

FIG. 3B illustrates a current flow through the first half loop 303 and the second half loop 304 of the two-half loop antenna 203. A current flow occurs in the two-half loop antenna 203 when a radio frequency signal is coupled to the two-half loop antenna 203 through the feeding point 207 of the two-half loop antenna 203. The current flow through the first half loop 303 and the second half loop 304 is illustrated with the help of solid arrows within the first half loop 303 and the second half loop 304. The current flow in a segment of the first half loop 303 as compared to the current flow in a corresponding segment of the second half loop that faces the segment of the first half loop is in opposite direction as illustrated in FIG. 3B. The current distribution across the two-half loop antenna 203 can be analysed as a current profile with a half positive and half negative over the entire physical length of the two-half loop antenna 203. The two-half loop antenna 203 also includes two inversion points, i.e., the first inversion point 305 in the first half loop 303, and the second inversion point 306 in the second half loop 304. The first inversion point 305 is at the farthest distance or diagonally across from the first end section 206 of the first half loop 303. Similarly, the second inversion point 306 is at the farthest distance or diagonally across from the first end section 207 of the second half loop 304. The first inversion point 305 and the second inversion point 306 correspond to zero-crossing points of current in a one full-wavelength of a radio-frequency signal that exists over the two-half loop antenna 203, when the radio-frequency signal is transmitted over the two-half loop antenna 203. The antenna segments of the two-half loop antenna 203 that have the highest amplitude of current (corresponding to the radio frequency signal being transmitted through the two-half loop antenna 203) are the transverse segments 209 of the first half loop and the second half loop.

The above described geometry of the two-half loop antenna 203 allows the antenna impedance to be relatively small. In one implementation, the antenna impedance is less than 200Ω. Further, the radiation pattern of the two-half loop antenna 203 is a direct consequence of the geometry of the two-half loop antenna 203 as described above. The radiation pattern of the two-half loop antenna 203 is very similar to a half-wave loop rather than to a full-wave antenna. Such radiation pattern is a result of the transverse segments of the first half loop 303 and the second half loop 304 being close to the feeding point 207. Radiating nulls in the radiation pattern of the two-half loop antenna 203 are smoother than radiation pattern of similar traditional antennas. The radiation pattern of the two-half loop antenna 203 renders an important advantage to keep the efficiency of the two-half loop antenna 203 high when the structure of the two-half loop antenna 203 is integrated into the hearing aid component 100 and worn on an ear.

In one implementation, with a 0.5 mm width, 75 mm long copper track of the two-half loop antenna 203, onto a 120 μm polyimide substrate a natural resonance around 4 GHz in free space was obtained with a low impedance at feeding=(26+j*30) Ω. In this implementation, the radiation pattern of two-half loop antenna 203 in free space includes multiple roots. The radiation pattern is partly defined by the half-wave loops, and partly by the two-half loop antenna 203 seen as a folded dipole. This gives an almost isotropic radiation pattern to the two-half loop antenna 203, with the main lobe at 1.3 dBi and the radiation nulls at −4 dBi.

As compared to currently used magnetic loop antennas, the two-half loop antenna 203 shows a 5 dB improvement in efficiency as per simulation results. In the polar cuts a gain of more than 6 dB is visible towards the backside (i.e., towards a user's ear). Further, the radiation pattern around a user's head as per simulation results indicates that more energy is obtained as compared to other similar hearing devices in case of binaural communication.

Figure 4B:
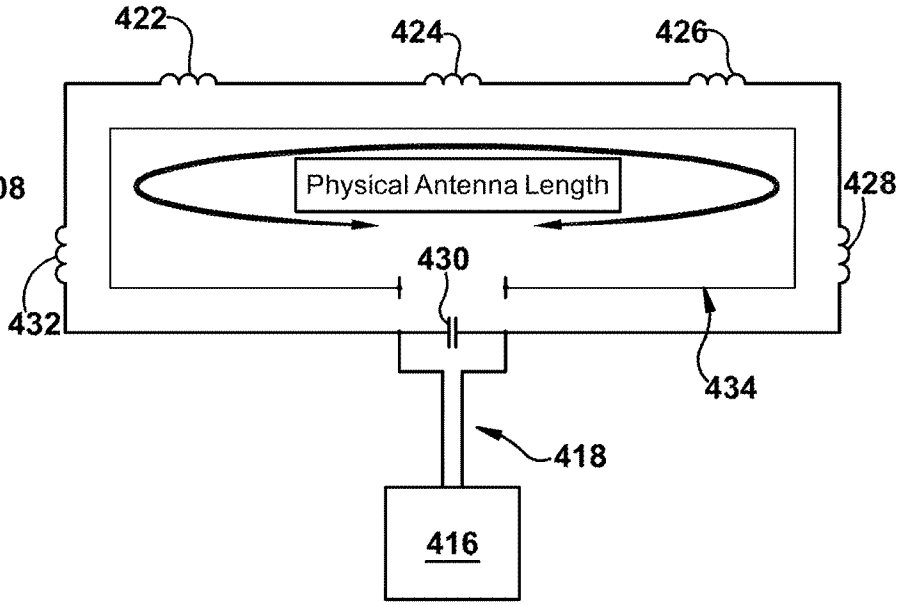
FIG. 4B illustrates a circuit diagram of the two-half loop antenna with tuning elements added to compensate the physical length of the two-half loop antenna to be approximately equal to the wavelength of a radio frequency signal is transmitted over the two-half loop antenna.
Figure 4A:
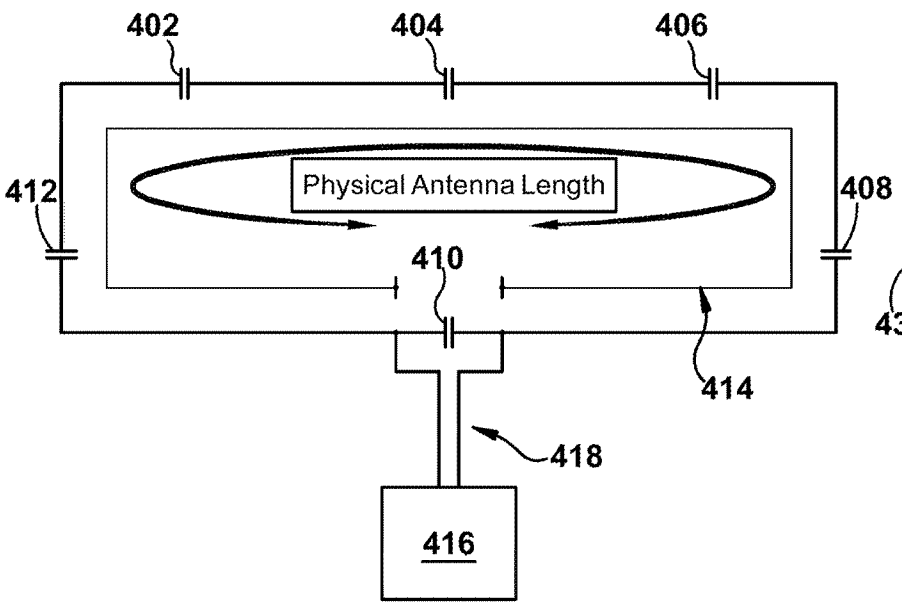
FIG. 4A illustrates a circuit diagram of the two-half loop antenna with tuning elements added to compensate the physical length of the two-half loop antenna to be approximately equal to the wavelength of a radio frequency signal is transmitted over the two-half loop antenna.

FIG. 4A illustrates a circuit diagram of the two-half loop antenna with tuning elements added to compensate the physical length of the two-half loop antenna 203 to be approximately equal to the wavelength of the radio frequency signal is transmitted over the two-half loop antenna 203. FIG. 4A includes the radio frequency transceiver 416, capacitors 412, 402, 404, 406, 408, and 410, the feeding lines 202, the feeding point 207, and the two-half loop antenna 203. The capacitors 402, 404 (at the mid-point), 406, 408, and 412 illustrate one implementation of the tuning elements 204 (described above in FIG. 2). The tuning element 410 connected in parallel at the feeding point between the two half loops illustrates one implementation of the tuning element 234 (described above in FIG. 2). FIG. 4A illustrates a schematic top view of the two-half loop antenna 203 and also illustrates the physical antenna length of the two-half loop antenna 203 as described above.

In one implementation, the two-half loop antenna 203 may be loaded by the nearby dielectric structure inside the hearing aid component 100 or by the dielectric structure in combination with a loading due to a user's head on which the hearing aid component is to be worn. The loading of the two-half loop antenna 203 by the combination of the dielectric structure along with the user's head may result in an increase in the electrical antenna length of the two-half loop antenna 203 greater than one wavelength (λ) of the radio frequency signal to be transmitted through the two-half loop antenna 203. Therefore, in order to compensate the electrical length of the two-half loop antenna 203, capacitors 402, 404, 406, 408, and 412 may be used to decrease the electrical length of the two-half loop antenna 203 to match up to the wavelength (λ) of the radio frequency signal to be transmitted through the two-half loop antenna 203, as illustrated in FIG. 4A.

One or more tuning elements (i.e., the capacitors 402, 404, 406, 408, 410 and 412 in FIG. 4A) are used to adjust the antenna impedance of the two-half loop antenna 203 to match the impedance set up by the radio frequency transceiver 416. Further, FIG. 4A illustrates the two-half loop antenna 203 being tuned with one parallel component (capacitor 410) and five series components (i.e., capacitors 402, 404, 406, 408 and 412). In some implementations, fewer or greater number of capacitors may be utilized for adjusting the impedance of the two-half loop antenna 203.

FIG. 4B illustrates a circuit diagram of the two-half loop antenna with tuning elements added to compensate the physical length of the two-half loop antenna 203 to be approximately equal to the wavelength of the radio frequency signal is transmitted over the two-half loop antenna 203. FIG. 4B includes the radio frequency transceiver 416, inductors 422, 424 (at the mid-point), 426, 428, 430 and 432, the feeding lines 202, the feeding point 207, and the two-half loop antenna 203. The inductors 422, 424, 426, 428, 430 and 432 illustrate one implementation of the tuning elements 204 (described above in FIG. 2). The tuning element 430 connected in parallel at the feeding point between the two half loops illustrates one implementation of the tuning element 234 (described above in FIG. 2). FIG. 4B illustrates a schematic top view of the two-half loop antenna 203 and also illustrates the physical antenna length of the two-half loop antenna 203 as described above.

In one implementation, the two-half loop antenna 203 has a physical length with a value smaller than one-half of the wavelength (λ) of the radio frequency signal to be transmitted over the two-half loop antenna 203. Therefore, in order to make the electrical length of the two-half loop antenna 203 approximately equal to the wavelength (λ) of the radio frequency signal to be transmitted, inductors 422, 424, 426, 428, and 432 may be used to increase the electrical length of the two-half loop antenna 203 to match up to the wavelength (λ) of the radio frequency signal to be transmitted through the two-half loop antenna 203, as illustrated in FIG. 4B.

One or more tuning elements (i.e., the inductors 422, 424, 426, 428, and 432 in FIG. 4B) are used to adjust the antenna impedance of the two-half loop antenna 203 to match the impedance set up by the radio frequency transceiver 416. Further, FIG. 4B illustrates the two-half loop antenna 203 being tuned with one parallel component (capacitor 430) and five series components (i.e., inductors 422, 424, 426, 428 and 432). In some implementations, fewer or greater number of inductors may be utilized for adjusting the impedance of the two-half loop antenna 203.

Many other example embodiments can be provided through various combinations of the above described features. Although the embodiments described hereinabove use specific examples and alternatives, it will be understood by those skilled in the art that various additional alternatives may be used and equivalents may be substituted for elements and/or steps described herein, without necessarily deviating from the intended scope of the application. Modifications may be desirable to adapt the embodiments to a particular situation or to particular needs without departing from the intended scope of the application. It is intended that the application not be limited to the particular example implementations and example embodiments described herein, but that the claims be given their broadest reasonable interpretation to cover all novel and non-obvious embodiments, literal or equivalent, disclosed or not, covered thereby.

What is claimed is:

1. A hearing device component comprising:

a wireless communication unit; and an antenna including a two-half loop antenna, wherein the two-half loop antenna comprises:

a conductor and interconnected tuning elements defining a first half loop and a second half loop configured to be fed in series with a wireless signal from the wireless communication unit, wherein the first half loop and the second half loop comprise respective half loops of the two-half loop antenna;

the first half loop comprising a first end section of the first half loop, wherein the first end section of the first half loop is coupled to the wireless communication unit;

the second half loop comprising a second end section of the second half loop, wherein the second end section of the second half loop is coupled to the wireless communication unit;

respective transverse segments of the first half loop and second half loop join the first half loop and the second half loop at a mid-point of the two-half loop antenna; wherein a physical antenna length of the two-half loop antenna is less than ¾ of the wavelength of the wireless signal to be transmitted or received through the two-half loop antenna and wherein an electrical length of the two-half loop antenna is approximately equal to the wavelength of the wireless signal to be transmitted or received, the first and second half loops of the two-half loop antenna are configured to have a highest amplitude of the current flow in the transverse segments.

2. The hearing device component of claim 1, further comprising feeding lines connecting the wireless communication unit to a feeding point at the first end section of the first half loop and the second end section of the second half loop.

3. A hearing device component comprising:

a wireless communication unit; and an antenna including a two-half loop antenna, wherein the two-half loop antenna comprises:

a conductor and interconnected tuning elements defining a first half loop and a second half loop configured to be fed in series with a wireless signal from the wireless communication unit, wherein the first half loop and the second half loop comprise respective half loops of the two-half loop antenna;

the first half loop comprising a first end section of the first half loop, wherein the first end section of the first half loop is coupled to the wireless communication unit;

the second half loop comprising a second end section of the second half loop, wherein the second end section of the second half loop is coupled to the wireless communication unit;

respective transverse segments of the first half loop and second half loop join the first half loop and the second half loop at a mid-point of the two-half loop antenna;

feeding lines connecting the wireless communication unit to a feeding point at the first end section of the first half loop and the second end section of the second half loop;

wherein a physical antenna length of the two-half loop antenna is less than ¾ of the wavelength of the wireless signal to be transmitted or received through the two-half loop antenna and wherein an electrical length of the two-half loop antenna is approximately equal to the wavelength of the wireless signal to be transmitted or received, the distance between the feeding point of the two-half loop antenna and the mid-point of the two-half loop antenna is in a range of 0 to ¼ of the distance between the feeding point and a farthest point defined by a point at which an axial line through the feeding point and the mid-point intersects a plane perpendicular to the axial line and intersecting a point on the two-half loop antenna farthest from the feeding point.

4. The hearing device component of claim 1, wherein a first inversion point and a second inversion point are located at a separation distance that prevents the magnetic flux generated due to the currents flowing in the first half loop and the magnetic flux generated due to the current flowing in the second half loop from canceling the effect of each other.

5. The hearing device component of claim 1, wherein the wireless communication unit is a radio frequency transceiver the first and second inversion points correspond to zero crossing points of current in a one full-wavelength of a radio-frequency signal that exists over the two-half loop antenna when the radio-frequency signal is transmitted or received over the two-half loop antenna.

6. The hearing device component of claim 1, further comprising a first inversion point and a second inversion point of the two-half loop antenna, wherein the first inversion point is at the farthest distance or diagonally across from the first end section of the first half loop, and the second inversion point is at the farthest distance or diagonally across from the second end section of the second half loop.

7. The hearing device component of claim 6, further comprising a first distal point on the first half loop and a second distal point on the second half loop, wherein the first distal point is located between the first end section of the first half loop and the first inversion point and the second distal point is located between the second end section of the second half loop and the second inversion point.

8. The hearing device component of claim 7, wherein the first distal point and the second distal point are located at a separation distance that prevents the magnetic flux generated due to the currents flowing in the first half loop, and the magnetic flux generated due to the current flowing in the second half loop, from canceling the effect of each other.

9. The hearing device component of claim 1, wherein one of the one or more tuning elements is connected at a feeding point at the first end section of the first half loop and the second end section of the second half loop and in parallel between the first half loop and the second half loop.

10. The hearing device component of claim 1, further comprising a dielectric structure inside the hearing device component and configured to load the two-half loop antenna, wherein the electrical length of the two-half loop antenna being approximately equal to the wavelength of the wireless signal to be transmitted or received is caused at least partly by the load of the dielectric structure.

11. The hearing device component of claim 10, wherein the electrical length of the two half loop antenna is approximately equal to the wavelength of the wireless signal to be transmitted or received configured to be caused at least partly by the load of the dielectric structure in combination with dielectric loading by a user's head on which the hearing device component is configured to be worn.

12. The hearing device component of claim 1, wherein the one or more tuning elements set the antenna impedance to match the electrical length of the two-half loop antenna to the wavelength of the wireless signal to be transmitted or received.

13. The hearing device component of claim 12, further comprising a dielectric structure inside the hearing device component and cooperating with the one or more tuning elements to set the antenna impedance to match the electrical length of the two-half loop antenna to the wavelength of the wireless signal to be transmitted or received.

14. The hearing device component of claim 12, wherein one of the one or more tuning elements is connected at the mid-point of the two-half loop antenna.

15. The hearing device component of claim 12, wherein the one or more tuning elements further comprise one or more inductors and/or one or more capacitors.

16. The hearing device component of claim 12, wherein the tuning elements are configured to provide an approximately equal current distribution between the first half loop and the second half loop.

17. The hearing device component of claim 16, wherein the approximately equal current distribution of the antenna half loops is achieved using capacitors and/or inductors as the tuning elements in the first half loop and the second half loop.

18. The hearing device component of claim 1, wherein the physical antenna length of the two-half loop antenna is less than one-half of the wavelength of the wireless signal to be transmitted or received through the two-half loop antenna.

19. The hearing device component of claim 1, wherein the physical antenna length of the two-half loop antenna is less than ¼ of the wavelength of the wireless signal to be transmitted or received through the two-half loop antenna.

20. The hearing device component of claim 1, wherein the physical antenna length of the two-half loop antenna is in the range of 3 centimeters to 9 centimeters.

21. The hearing device component of claim 1, further comprising an antenna substrate wherein the two-half loop antenna includes conductors on the antenna substrate, a microphone, a battery, and a housing enclosing the antenna substrate, the microphone, the battery, and the wireless communication unit.

22. A hearing device component comprising:

a wireless communication unit; and an antenna including a two-half loop antenna, wherein the two-half loop antenna comprises:

a conductor and interconnected tuning elements defining a first half loop and a second half loop configured to be fed in series with a wireless signal from the wireless communication unit, wherein the first half loop and the second half loop comprise respective half loops of the two-half loop antenna;

the first half loop comprising a first end section of the first half loop, wherein the first end section of the first half loop is coupled to the wireless communication unit;

the second half loop comprising a second end section of the second half loop, wherein the second end section of the second half loop is coupled to the wireless communication unit;

respective transverse segments of the first half loop and second half loop join the first half loop and the second half loop at a mid-point of the two-half loop antenna;

feeding lines connecting the wireless communication unit to a feeding point at the first end section of the first half loop and the second end section of the second half loop;

wherein a physical antenna length of the two-half loop antenna is less than ¾ of the wavelength of the wireless signal to be transmitted or received through the two-half loop antenna, wherein an electrical length of the two-half loop antenna is approximately equal to the wavelength of the wireless signal to be transmitted or received, wherein the first half loop and the second half loop comprise loops substantially rectangular in shape, and wherein the diameter of the first rectangular loop is approximately equal to one-half of the physical length of the two-half loop antenna and the diameter of the second rectangular loop is approximately equal to one-half of the physical length of the two-half loop antenna.

23. The hearing device component of claim 22, wherein the first half loop and the second half loop are laterally placed opposite to each other such that each side of the first rectangular loop and each corresponding side of the second rectangular loop are laterally opposite and separated by a predetermined separation distance.

24. A hearing device component comprising:

a wireless communication unit;

an antenna including a two-half loop antenna, wherein the two-half loop antenna comprises:

a conductor defining a first half loop and a second half loop configured to be fed in series with a wireless signal from the wireless communication unit, wherein the first half loop and the second half loop comprise respective half loops of the two-half loop antenna;

the first half loop comprising a first end section of the first half loop, wherein the first end section of the first half loop is coupled to the wireless communication unit;

the second half loop comprising a second end section of the second half loop, wherein the second end section of the second half loop is coupled to the wireless communication unit;

respective transverse segments of the first half loop and second half loop join the first half loop and the second half loop at a mid-point of the two-half loop antenna; and feeding lines connecting the wireless communication unit to a feeding point at the first end section of the first half loop and the second end section of the second half loop, wherein the distance between the feeding point of the two-half loop antenna and the mid-point of the two-half loop antenna is in a range of 0 to ¼ of the distance between the feeding point and a farthest point defined by a point at which an axial line through the feeding point and the mid-point intersects a plane perpendicular to the axial line and intersecting a point on the two-half loop antenna farthest from the feeding point.

25. A hearing device component comprising: a microphone for reception of sound and conversion of the received sound into a corresponding first audio signal; a signal processor for processing the first audio signal into a second audio signal; a wireless communication unit configured for wireless data communication; and an antenna for emission of an electromagnetic field, the antenna being coupled with the wireless communication unit, the antenna having a total length less than three quarters of a wavelength of the emitted electromagnetic field; wherein a part of the antenna extends from a first side of the component to a second side of the component; wherein the antenna has a mid-point located at a part of the antenna extending from the first side to the second side; wherein the mid-point joins transverse segments from the part of the antenna on the first side and the part of the antenna on the second side; and wherein the antenna is configured to have a highest amplitude of the current flow in the transverse segments.

26. A hearing device component comprising: a microphone for reception of sound and conversion of the received sound into a corresponding first audio signal; a signal processor for processing the first audio signal into a second audio signal; a wireless communication unit configured for wireless data communication; an antenna for emission of an electromagnetic field, the antenna being coupled with the wireless communication unit, the antenna having a total length less than three quarters of a wavelength of the emitted electromagnetic field, and feeding lines from the wireless communication unit to a feeding point at end sections of the antenna; wherein a part of the antenna extends from a first side of the component to a second side of the component wherein the antenna has a mid-point located at a part of the antenna extending from the first side to the second side; and wherein the distance between the feeding point and the mid-point is in a range of 0 to ¼ of the distance between the feeding point and a farthest point defined by a point at which an axial line through the feeding point and the mid-point intersects a plane perpendicular to the axial line and intersecting a point on antenna farthest from the feeding point.

27. The hearing device component of claim 24, wherein a physical antenna length of the two-half loop antenna is less than ¾ of the wavelength of the wireless signal to be transmitted or received through the two-half loop antenna and wherein an electrical length of the two-half loop antenna is approximately equal to the wavelength of the wireless signal to be transmitted or received.

* * * * *